US009225074B2

(12) United States Patent
Hicks et al.

(10) Patent No.: US 9,225,074 B2
(45) Date of Patent: Dec. 29, 2015

(54) WIDE-BAND ACTIVE ANTENNA SYSTEM FOR HF/VHF RADIO RECEPTION

(71) Applicants: Brian C. Hicks, Alexandria, VA (US); Kenneth P. Stewart, Upper Marlboro, MD (US); Tracy Clarke, Glenn Dale, MD (US); Nagini P. Dalal, Torrance, CA (US); Henrique Schmitt, Greenbelt, MD (US); Paul S. Ray, Alexandria, VA (US); Stephen J. Burns, Hollis, NH (US); Namir E. Kassim, Annandale, VA (US); Emil J. Polisensky, Alexandria, VA (US); Norman R. Mcglothlin, Jr., Alexandria, VA (US)

(72) Inventors: Brian C. Hicks, Alexandria, VA (US); Kenneth P. Stewart, Upper Marlboro, MD (US); Tracy Clarke, Glenn Dale, MD (US); Nagini P. Dalal, Torrance, CA (US); Henrique Schmitt, Greenbelt, MD (US); Paul S. Ray, Alexandria, VA (US); Stephen J. Burns, Hollis, NH (US); Namir E. Kassim, Annandale, VA (US); Emil J. Polisensky, Alexandria, VA (US); Norman R. Mcglothlin, Jr., Alexandria, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 235 days.

(21) Appl. No.: 14/072,715

(22) Filed: Nov. 5, 2013

(65) Prior Publication Data

US 2014/0184463 A1 Jul. 3, 2014

Related U.S. Application Data

(60) Provisional application No. 61/722,581, filed on Nov. 5, 2012.

(51) Int. Cl.

| | |
|---|---|
| ***H01Q 21/26*** | (2006.01) |
| ***H01Q 21/24*** | (2006.01) |
| *H01Q 9/28* | (2006.01) |

(52) U.S. Cl.

CPC . *H01Q 21/24* (2013.01); *H01Q 9/28* (2013.01)

(58) Field of Classification Search

CPC ..... H01Q 21/062
USPC ..... 343/797, 730, 821, 859
See application file for complete search history.

(56) References Cited

U.S. PATENT DOCUMENTS

| | | | | |
|---|---|---|---|---|
| 3,952,310 A * | 4/1976 | Griffee | H01Q 21/29 343/730 |
| 2008/0204343 A1 * | 8/2008 | Kildal | H01Q 9/16 343/792.5 |
| 2009/0051619 A1 * | 2/2009 | Hook | H01Q 1/38 343/893 |

* cited by examiner

*Primary Examiner* — Dieu H Duong
(74) *Attorney, Agent, or Firm* — US Naval Research Laboratory; Sally A. Ferrett

(57) ABSTRACT

An active antenna system for receiving electromagnetic radiation at frequencies below 100 MHz. The system includes a vertical support mast; a front end electronics unit including an active balun, the front end electronics unit affixed to the support mast; two crossed-dipole antennas affixed oriented at about 90 degrees to each other, each crossed-dipole antenna having two arms formed of electrically conductive material, each arm having an isoceles triangular frame with an apex of the frame electrically connected to a feedpoint of the front end electronics unit, each arm also having a longitudinal member extending from the apex to the center of the base of the triangular shape and a cross member extending between sides of the triangular frame. The system can operate independently or as part of a long wavelength array for astronomical radio telescope applications.

7 Claims, 16 Drawing Sheets

PARTS LIST

| ITEM | QTY | PART NUMBER | DESCRIPTION |
|---|---|---|---|
| 401 | 1 | EXTRUSION 1 | CHANNEL |
| 402 | 1 | EXTRUSION 2 | CHANNEL |
| 403 | 1 | EXTRUSION 1 LEFT | CHANNEL |
| 404 | 1 | EXTRUSION 3 | CHANNEL |
| 405 | 1 | EXTRUSION 7 | CHANNEL |
| 406 | 1 | TAB | 1/8 X .75 FLAT ALUM |

| FREQUENCY | GAIN | E-PLANE | | H-PLANE | |
|---|---|---|---|---|---|
| | (dBi) | -3 dB | -6 dB | -3 dB | -6 dB |
| 20 MHz | 4.0 | 41° | 57° | 51° | 66° |
| 40 MHz | 6.0 | 45° | 64° | 53° | 67° |
| 60 MHz | 5.9 | 48° | 71° | 55° | 68° |
| 80 MHz | 5.6 | 45° | 77° | 58° | 70° |

FIG. 7

WIDE-BAND ACTIVE ANTENNA SYSTEM FOR HF/VHF RADIO RECEPTION

CROSS-REFERENCE TO RELATED APPLICATIONS

This application claims the benefit of, and is a non-provisional application under 35 USC 119(e) of, U.S. provisional patent application 61/722,581 filed on Nov. 5, 2012, the entire disclosure of which is incorporated by reference herein.

BACKGROUND OF THE INVENTION

1. Technical Field

This is in the field of radio frequency receivers for astronomical observations.

2. Related Technology

Radio astronomy began in 1932 with the discovery of radio emission from the Galactic Center at the relatively long wavelength of 15 m (20 MHz) by Karl Jansky, as described in Jansky, K. G. 1932, Proc. Inst. Radio Engrs., Vol. 20, 1920. This pioneering work was followed by the innovative research of Grote Reber at frequencies ranging from 10-160 MHz (30-2 meter wavelength) in the 1940s that closely tied radio astronomy to the broader field of astronomy and astrophysics, as described in Reber, G. 1940, ApJ, 91, 621; Reber, G. 1944, ApJ, 100, 279; Reber, G. & Greenstein, J. L. 1947, The Observatory, 67, 15; Reber, G. 1949, S&T, 8, 139; and Reber, G. 1950, Leaflet of the Astronomical Society of the Pacific, 6, 67.

However, the requirement for impractically large single radio antennas or dishes to obtain resolution at long wavelengths (resolution $\theta \sim \lambda/D$, where $\theta$ is the angular resolution in radians, $\lambda$ is the observing wavelength in meters, and D is the diameter of the observing instrument in meters), quickly pushed the new field of radio astronomy to higher frequencies (shorter wavelengths). Thus, since increasing the antenna diameters was severely limited by cost and mechanical considerations, the field moved toward achieving higher resolution by decreasing the observing wavelength.

As early as 1946, Ryle and Vonberg and Pawsey and collaborators began to use interferometric techniques that relied on large arrays of simple dipoles or widely separated individual, small dishes to increase the effective diameter D without greatly increasing the cost. Even then, distortions introduced into the incoming radio signals by the Earth's ionosphere made imaging at long wavelengths difficult and appeared to place a rather short upper size limit to D at frequencies less than 100 MHz (wavelengths greater than 3 m) of about 5 km. Thus, the move to higher frequencies, even for interferometry, continued until, by the 1970 s, relatively few long wavelength radio astronomy telescopes were still operating at frequencies below 100 MHz. Some exceptions include the Ukrainian UTR-2, the 38 MHz survey with the Cambridge Low-Frequency Synthesis Telescope, and the Gauribidanur Radio Observatory (GEETEE).

The Tee Pee Tee (TPT) Clark Lake array was built by William C. (Bill) Erickson on a dry lake in the Anza-Borrego desert east of San Diego, Calif. (Erickson, Mahoney, & Erb 1982). The TPT was also limited to a maximum baseline D of 3 km because of concerns about ionospheric distortion.

An array of antennas that would measure interstellar radiation at long wavelengths with high resolution was first proposed by R. A. Perley of the National Radio Astronomy Observatory and W. C. Erickson of the University of Maryland in 1984., in "A Proposal for a Large, Low Frequency Array Located at the VLA Site", 14 Apr. 1984.

Perley and Erickson envisioned studying large scale emission around individual galaxies and clusters of galaxies, studying the low brightness regions of radio galaxies and quasars, radio sky surveys, studies of source variability at low frequencies to distinguish between intrinsic and instellar variation, studying the spectra of extragalactic objects, and studying normal spiral galaxies. They further envisioned studying pulsars, the galactic center, HII regions, flare stars, star clusters, galactic background emission, interstellar propagation effects, and exotic objects. Such a long wavelength high resolution array would also be useful for solar system observations, including the sun, the planets, the moon, and solar wind turbulence. They proposed operation in the 75 MHz range, with tenability over 20 MHz to allow operation in interference free bands.

BRIEF SUMMARY

One aspect of the invention is an active antenna system for receiving electromagnetic radiation at frequencies below 100 MHz, including a vertical support mast, a front end electronics unit including an active balun, the front end electronics unit affixed to the support mast, two crossed-dipole antennas affixed oriented at about 90 degrees to each other, each crossed-dipole antenna having two arms formed of electrically conductive material, each arm having an isoceles triangular frame with an apex of the frame electrically connected to a feedpoint of the front end electronics unit, each arm also having a longitudinal member extending from the apex to the center of the base of the triangular shape and a cross member extending between sides of the triangular frame.

BRIEF DESCRIPTION OF THE DRAWINGS

FIG. 7 is a table that summarizes the simulated antenna beam patterns at 20, 40, 60 and 80 MHz.

DETAILED DESCRIPTION

Figure 1:
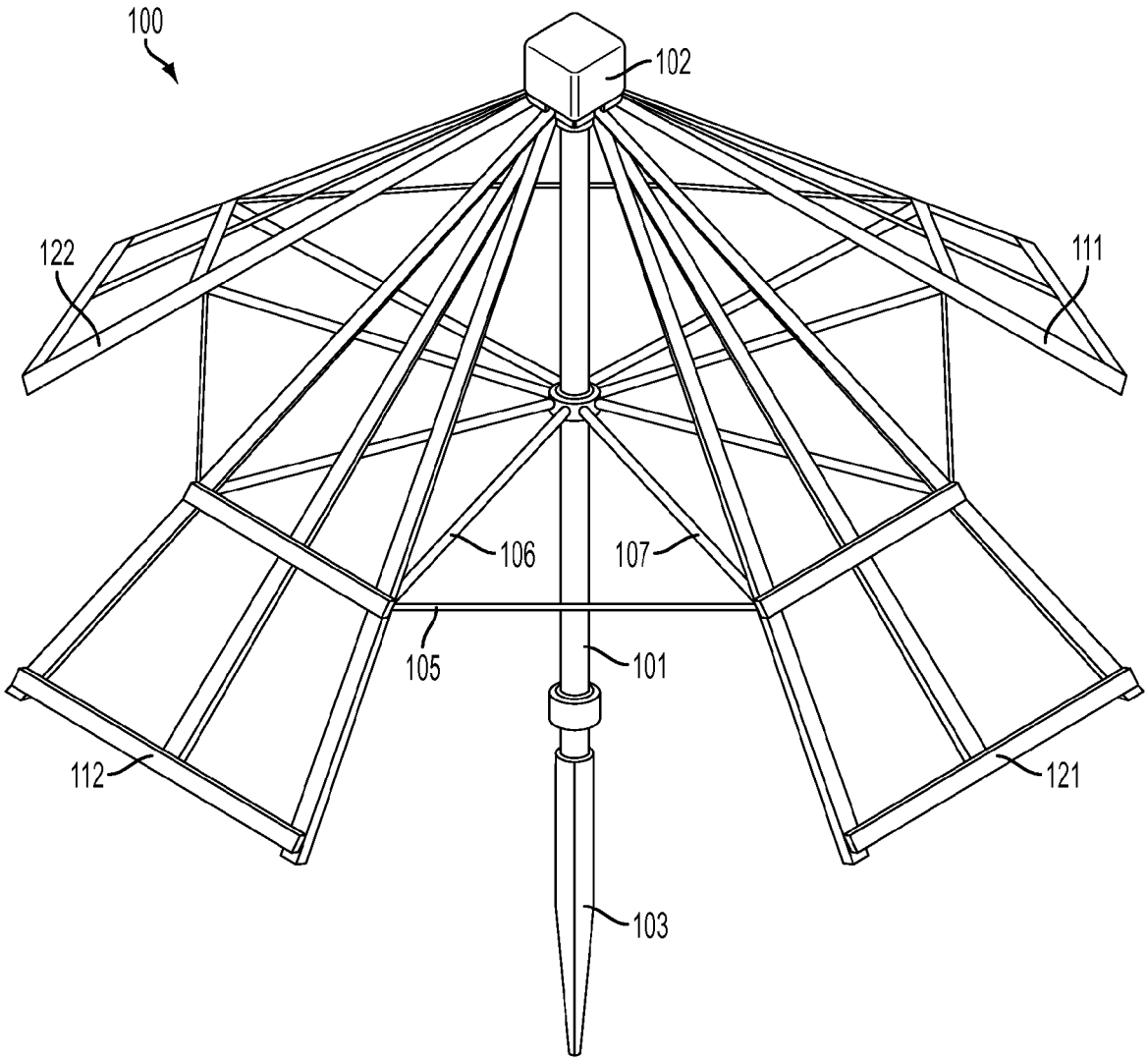
FIG. 1 shows an example of a full polarization, crossed dipole antenna element.

FIG. 1 illustrates a full polarization, crossed dipole antenna 100 that is useful as one component of an array of antenna stations that forms the long wavelength array ("LWA"). The long wavelength array is intended to enable astronomical research in the frequency range of about 20 MHz to about 80 MHz (wavelength 15 m to 3.75 m).

At long wavelengths (particularly at frequencies <100 MHz), the Galactic background radio emission is the ultimate limit on the effective noise temperature of any radio receiving system. Thus, it is preferred that the antenna system 100 should have an active balun/preamp (frontend) with enough gain that any noise contributed by components following the front end is negligible. Further, in order that the front end itself should not raise the total system noise temperature much above that of the fundamental Galactic background limit, it must have a noise temperature significantly below that of the Galactic background at the observing wavelengths of interest. One possible method of maintaining a low noise temperature is to cool the receiver, such cooling systems would make the overall system costs high, particularly when the system includes hundreds or thousands of antennae.

The Long Wavelength Array system is therefore designed as a compromise between low noise and affordability, with a design goal of a front end noise temperature better than 6 dB below the Galactic background noise temperature over a principal band of interest from 20-80 MHz. At 6 dB below the Galactic background, the increased integration time to reach a given sensitivity is only about 57% more than the integration time for a system perfect, noiseless balun/preamp.

In operation, the LWA will include about fifty antenna stations, with each antenna station being formed of 256 antenna elements distributed over an ellipse about 100 meters in an E/W direction by about 110 meters in the N/S direction. The LWA is planned to be spread over an area approximately 400 km in diameter. The antennas can be arranged in a quasi-random pattern intended to minimize sidelobes.

Each antenna 100 includes two electrically short, relatively fat, droopy-dipole antennas. The antenna also includes a mast 101 to support the droopy dipoles, and includes a fixed ground screen 200, shown in FIG. 2, to stabilize the properties of the ground under the antenna against changes in moisture content caused by rain. Each antenna element 100 also includes a front end electronics unit 102 that includes an amplified, or "active", balun/pre-amplifier at the apex of the dipole arms.

The antenna 100 can also be used for other radio astronomy applications other than the LWA, either in an array or singly.

Figure 2:
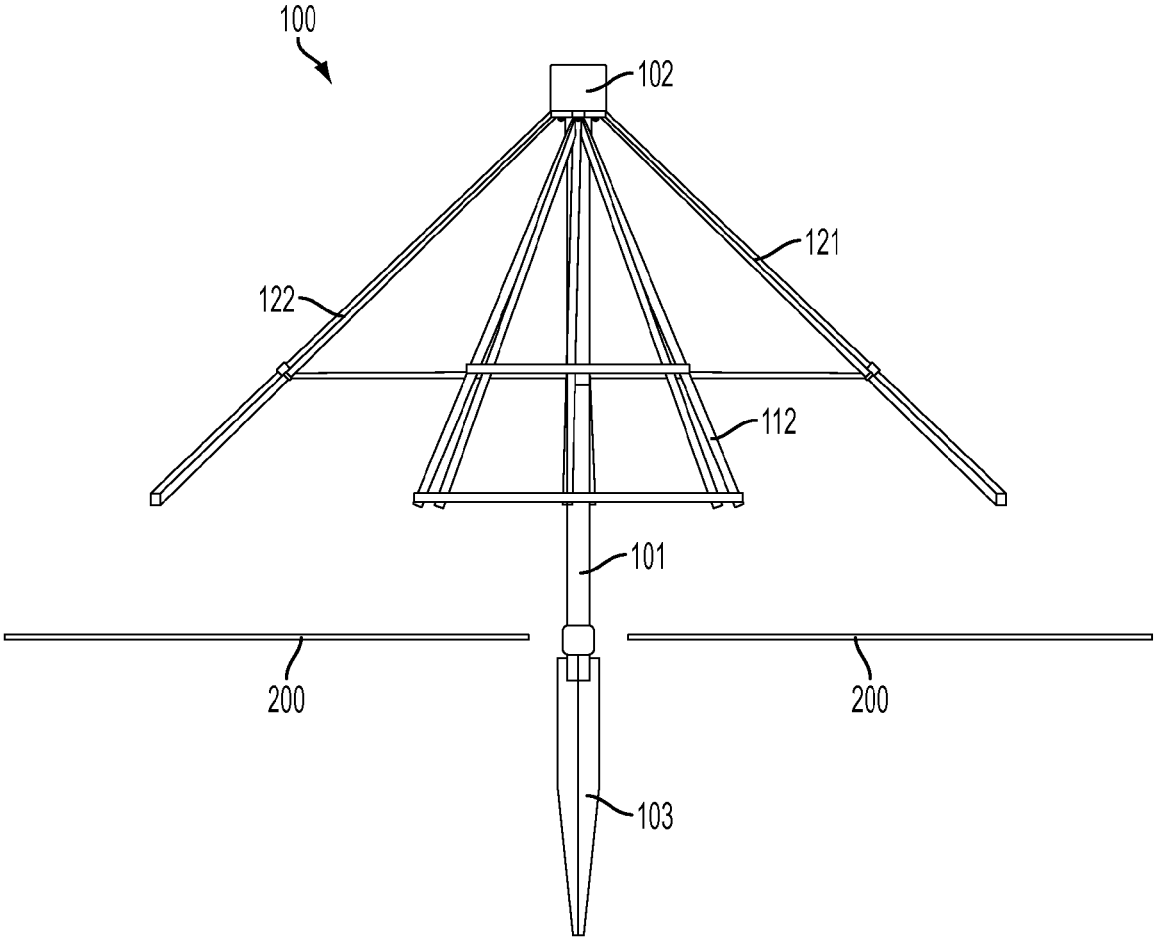
FIG. 2 is a side view of the antenna element of FIG. 1 with a ground screen.
Figure 3:
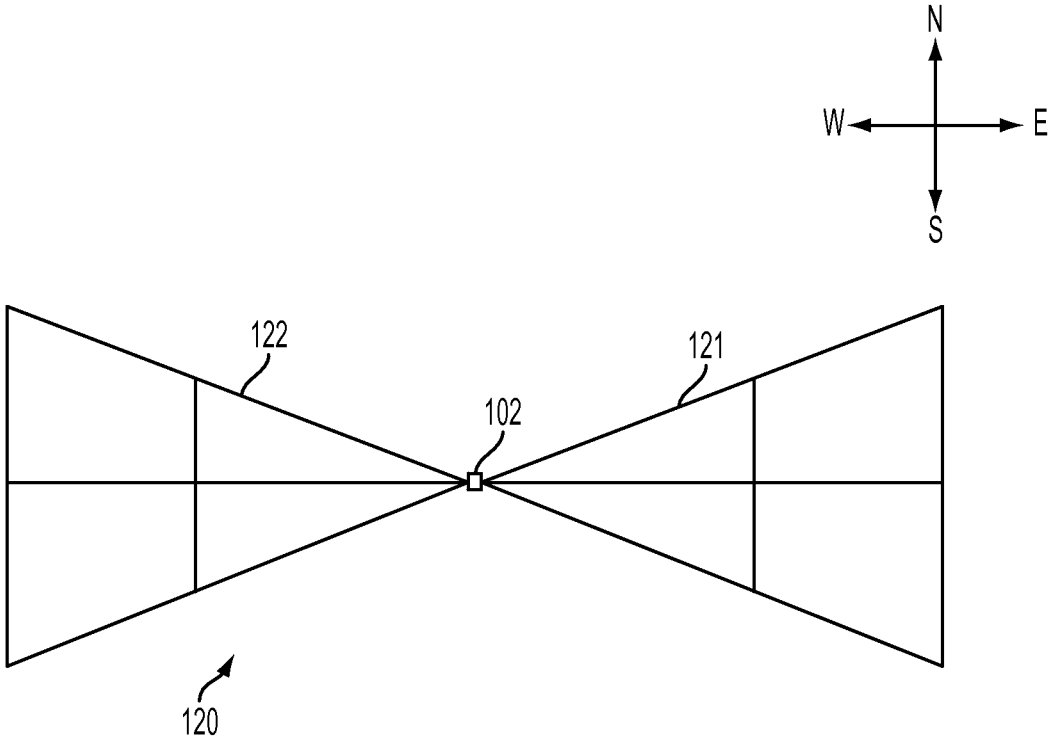
FIG. 3 is a top view of one of the two crossed dipole antennas that form the full polarization, crossed dipole antenna element of FIG. 1.

As seen in FIG. 1, the antenna 100 includes two crossed dipole antennas 110 and 120. FIG. 3 illustrates a top view of one of the dipole antennas 120, which includes two dipole arms 121 and 122, oriented with its principal axis aligned along the East-West direction. As seen in FIGS. 1 and 2, the dipole arms 121 and 122 slope downward at about a 45 degree angle. The downward angle improves the antenna's sky coverage compared to a simple, straight, non-droopy dipole. The angle can be slightly greater or lesser than 45 degrees, for example, can be between about 40 and about 50 degrees, however, the 45 degree angle is believed to provide the best sky coverage.

Each of the four dipole arms 111, 112, 121, 122 is attached to a different feedpoint of the front end electronics unit 102, which is located at the top of the central mast 101.

Figure 4:
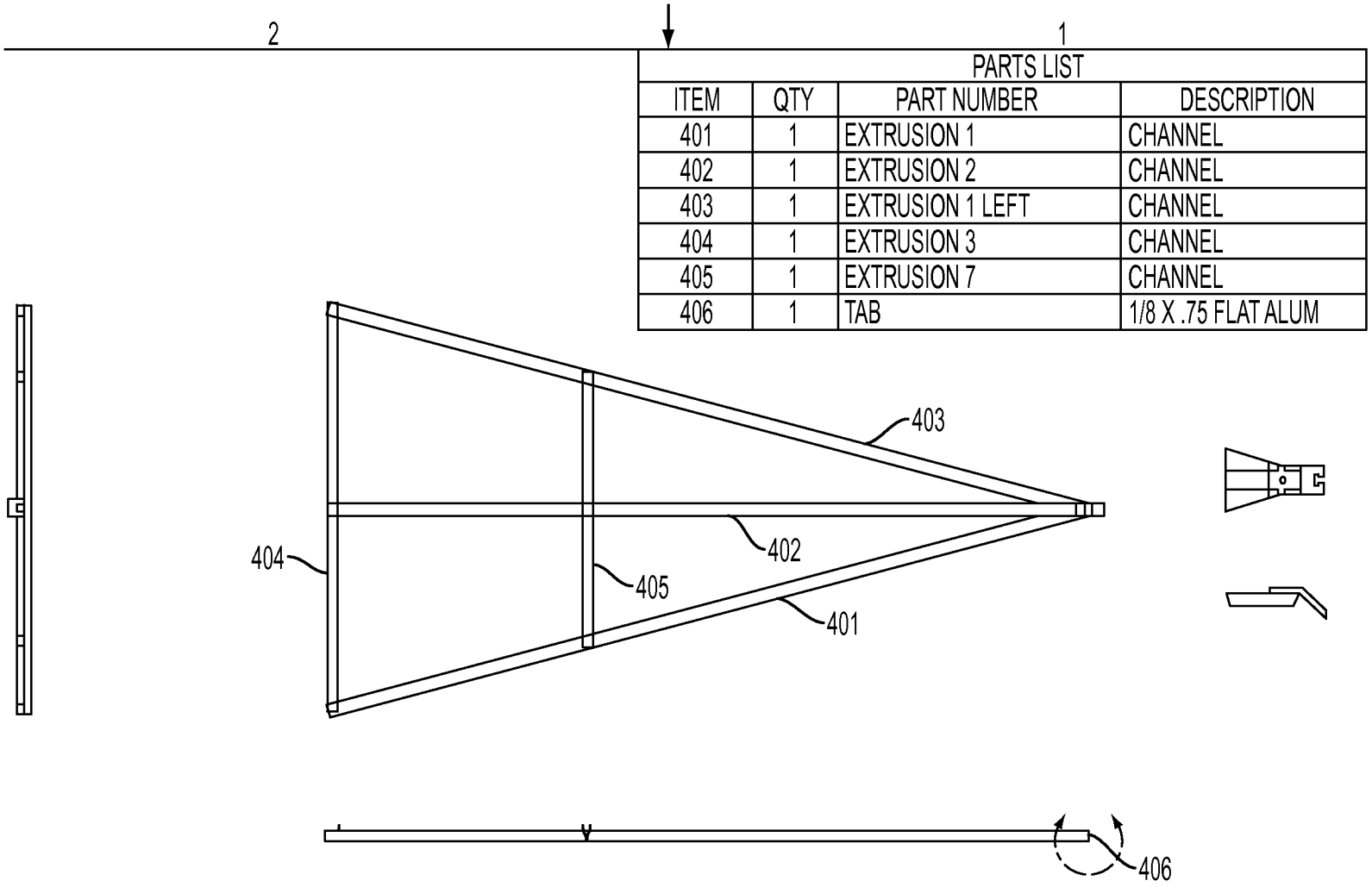
FIG. 4 illustrates one of dipole antenna arms, formed of a triangular frame with a single vertical bar and a single horizontal crosspiece, in more detail.

In this example, each of the dipole antenna arms is formed of a triangular frame of aluminum angle or channel pieces 401, 403, 404, with a single vertical bar 402 and a single horizontal crosspiece 405 as shown in more detail in FIG. 4. Each of these components is an electrically conductive material. The horizontal crosspiece 405 increases the stiffness of the dipole arm. The height of the triangular frame is about 1.5 meters, and the base of the triangular frame is approximately 0.8 meters.

Aluminum is a preferred material for the dipole arms, due to aluminum's electrical performance and light weight, however, other electrically conductive materials can also be suitable. Other cross sectional profiles can also be suitable for the individual pieces that form the dipoles.

As seen in FIGS. 1 and 2, the mast 101 can also include a ground anchor portion 103 that is intended to be buried in the ground. This ground anchor portion 103 can be shaped to help maintain the antenna system 100 in an upright position, for example, with a pointed end and stabilizing vertical protrusions. One suitable ground anchoring system is an OZ-POST® ground anchoring system available commercially from Ozco Building Products, headquartered in Richardson, Tex. The mast can be formed of steel or another strong structural material. If the mast is metallic or electrically conductive, it is electrically isolated from the dipole antenna elements and the front end electronic feedpoints.

The antenna 100 is arranged with one of the dipoles 110 aligned in a north-south orientation, and the other dipole 120 aligned in an east-west orientation.

The system can also include a non-conductive support frame to help maintain the dipole arms in their intended position. This frame can be attached at about mid-way along the vertical mast, and be formed of two spokes 106, 107 extending from the mast 101 to each of the dipole arms, with additional non-conductive support beams 105 extending between adjacent dipole arms.

This system 100 provides low cost, high mechanical stability, and good electrical performance. In particular, the system provides an upward-looking receptor that is optimized for use in synthetic aperture arrays, meeting or exceeding the following design goals: a 6 dB Galactic background dominated noise across the entire 20 to 80 MHz, a symmetric upward-looking beam pattern optimized to minimize sidelobes when utilized in synthetic aperture array applications, a high linearity—input referenced $3^{rd}$ order intercept (IIP3) of 2.3 dBm, at a low manufacturing cost.

In this example, the active balun has a specific impedance match (100Ω), and establishes a receiver noise temperature of approximately 255 Kelvin that is well below the Galactic background from 20 to 80 MHz (~3500K).

FIG. 5A-6D show the simulated E- and H-plane patterns over a range of frequencies for the dipole antenna 100, oriented at 45 degrees from the vertical. The scale is logarithmic total power with a normalization of unity at the zenith and −10 dB per radial division below that.

Figure 5A:
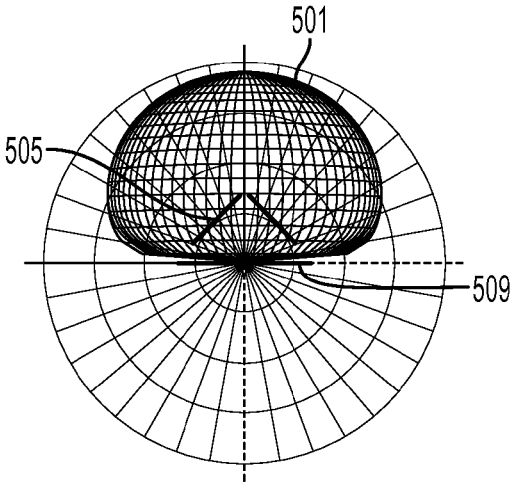
FIGS. 5A, 5B, 5C, 5D, 6A, 6B, 6C, and 6D show the simulated E- and H-plane patterns over a range of frequencies for full polarization, crossed dipole antenna element of FIG. 1.
Figure 5C:
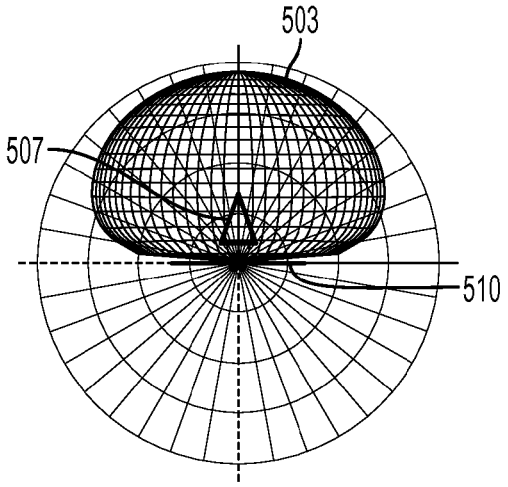
Figure 5B:
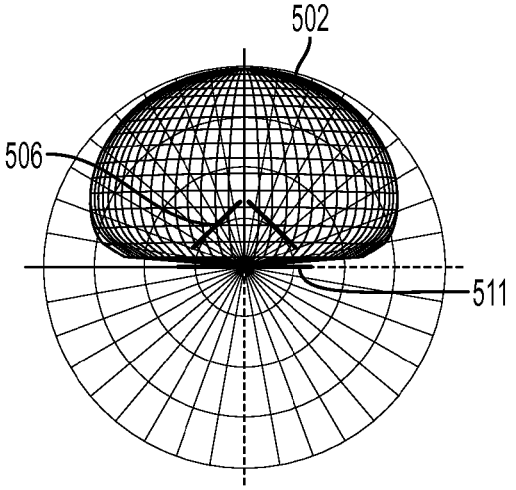
Figure 5D:
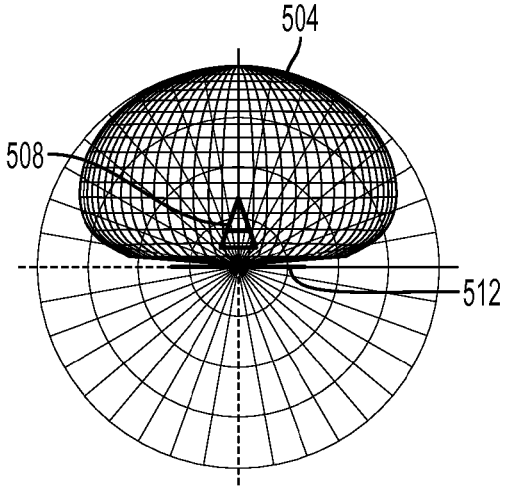
Figure 6A:
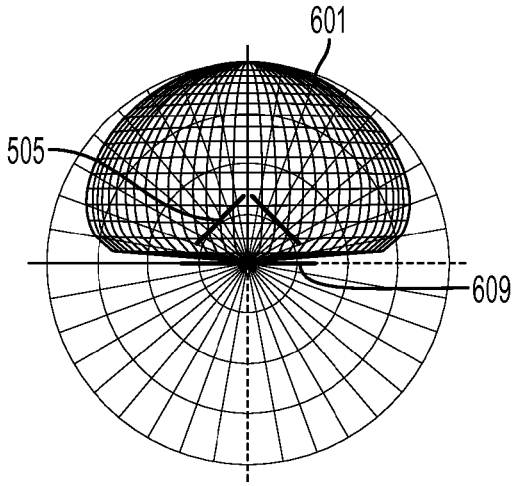
Figure 6C:
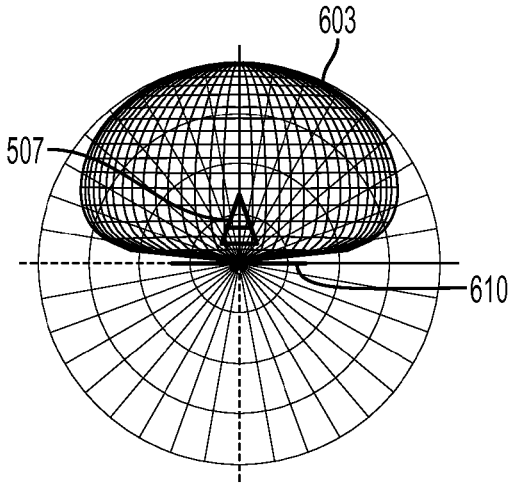
Figure 6B:
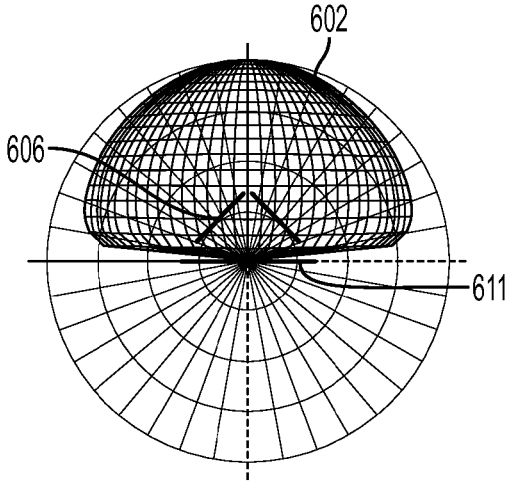
Figure 6D:
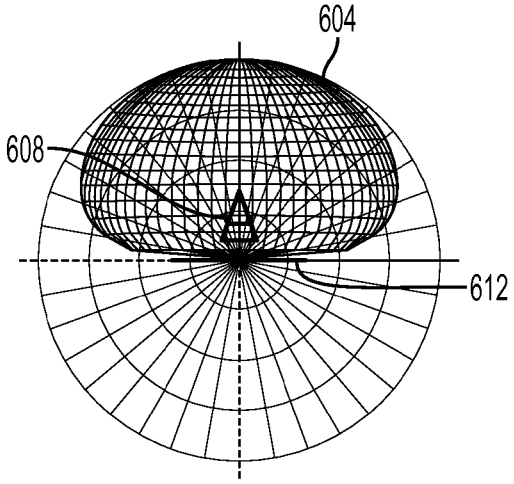

FIG. 5A shows the simulated E-plane pattern 501 at 20 MHz and FIG. 5B shows the simulated E-plane pattern 502 at 40 MHz for the tied fork antenna 100 of FIG. 1. FIG. 5C shows the simulated H-plane pattern 503 at 20 MHz and FIG. 5D shows the simulated H-plane pattern 504 at 40 MHz. The antenna shapes 505, 506, 507, and 508 viewed edge on and front on, respectively are overlaid on the E and H patterns to show the antenna orientation. The solid lines 509, 510, 511, and 512 along the horizontal axis in the figures represents the ground screen viewed edge-on. FIG. 6A shows the simulated E-plane pattern 601 at 60 MHz and FIG. 6B shows the simulated E-plane pattern 602 at 80 MHz for the tied fork antenna 100 with crosspiece of FIG. 1. FIG. 6C shows the simulated H-plane pattern 603 at 40 MHz and FIG. 6D shows the simulated H-plane pattern 604 at 80 MHz. The antenna shapes 605, 606, 607, and 608 viewed edge-on and front-on, respectively are overlaid on the E and H patterns to show the antenna orientation. The solid lines 609, 610, 611, and 612 along the horizontal axis in the figures represents the ground screen viewed edge on. It should be noted that although the simulations were initially carried out with a single polarization to enhance computing speed, final checks with the polarizations in place showed that the presence of the other polarization did not change the results. The table in FIG. 7 summarizes the simulated antenna beam patterns at 20, 40, 60 and 80 MHz. The values in the table are the zenith angles at which the power pattern is down by 3 dB and 6 dB from the zenith gain.

The antenna's front end electronics unit 102 includes an active-balun design that incorporate low-cost Monolithic Microwave Integrated Circuits (MMICs), plus an additional 12 dB of gain to handle cable losses without affecting noise performance, a local voltage regulator, an integral 5th order Butterworth filter, feedpoint connections, and protection against transients (e.g., lightning).

Figure 8:
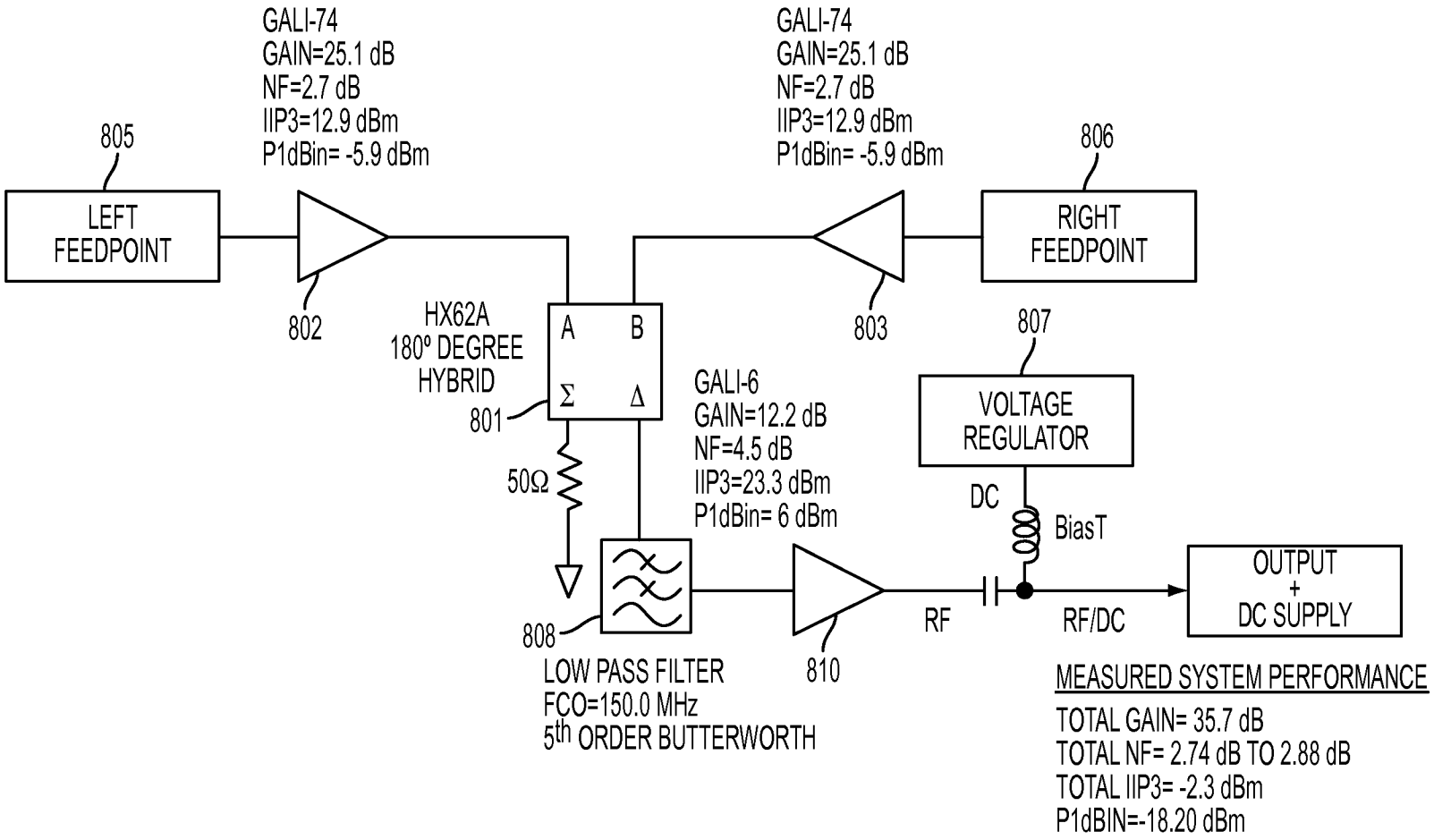
FIG. 8 shows the block diagram for one polarization of an exemplary front end electronics unit.
Figure 9:
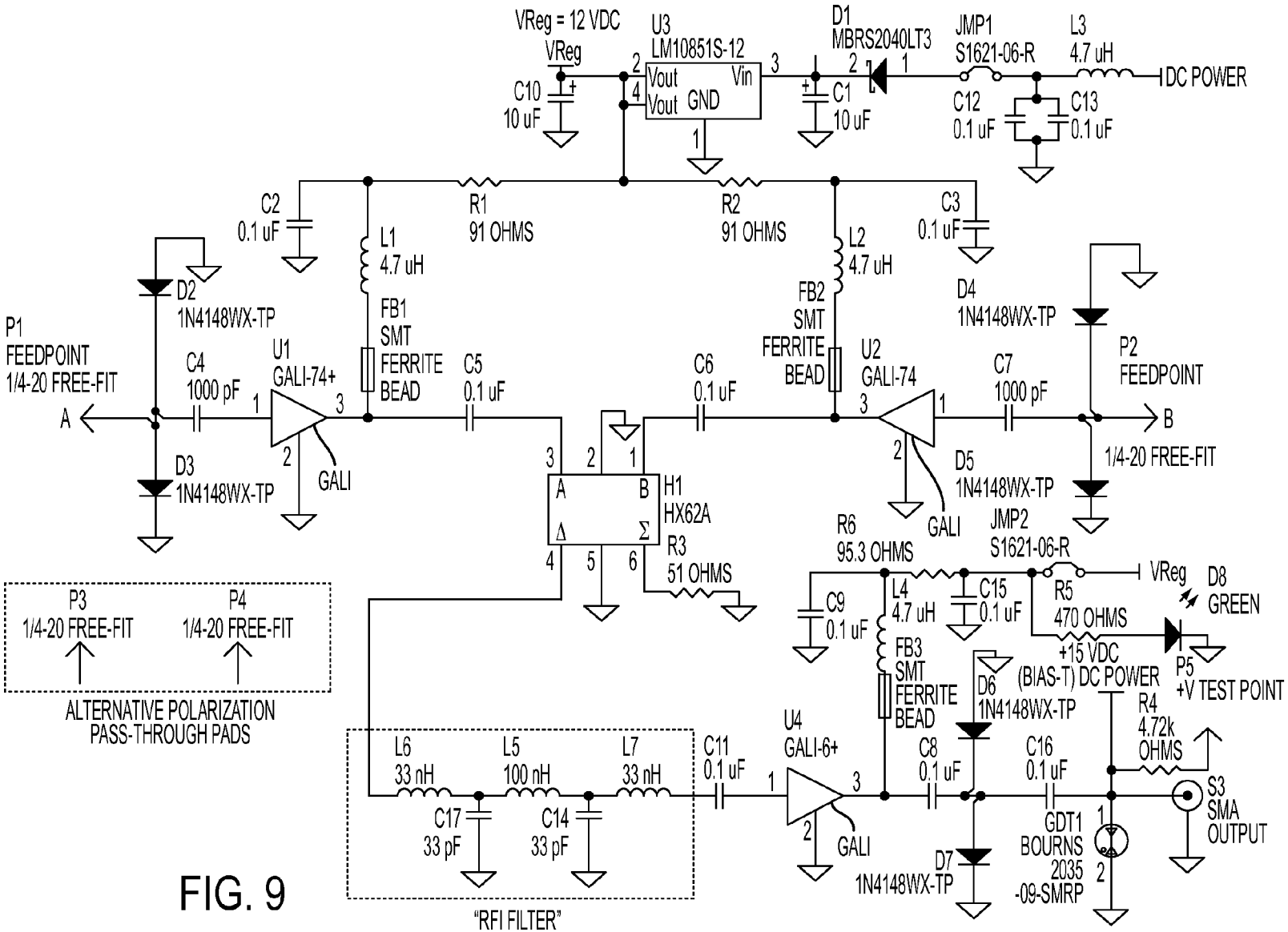
FIG. 9 shows the circuit diagram for one polarization of the front end electronics unit.

FIG. 8 shows the block diagram for one polarization of an exemplary front end electronics unit, and FIG. 9 shows the circuit diagram for one polarization of the front end electronics unit. The front end electronics unit has dual polarization capabilities formed by rotating two identical double-sided FEE printed circuit boards 90 degrees and bolting them together back-to-back with ground planes touching. This geometry provides isolation between polarizations, serviceability, and economy of fabrication.

Figure 10:
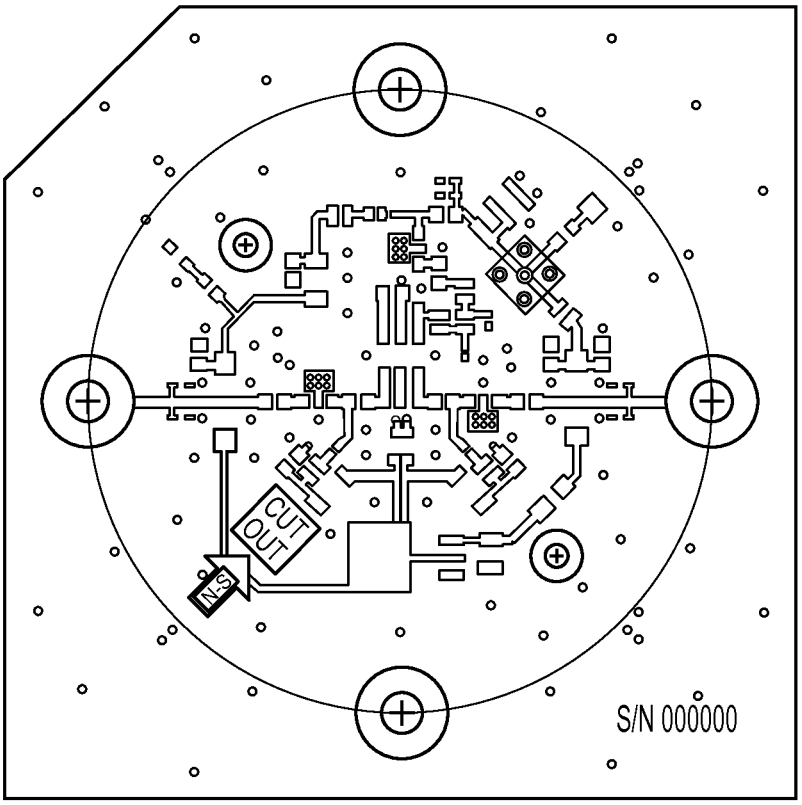
FIG. 10 illustrates a pattern for a circuit board with instructions for populating the two back to back circuit boards that form the front end electronics.
Figure 11:
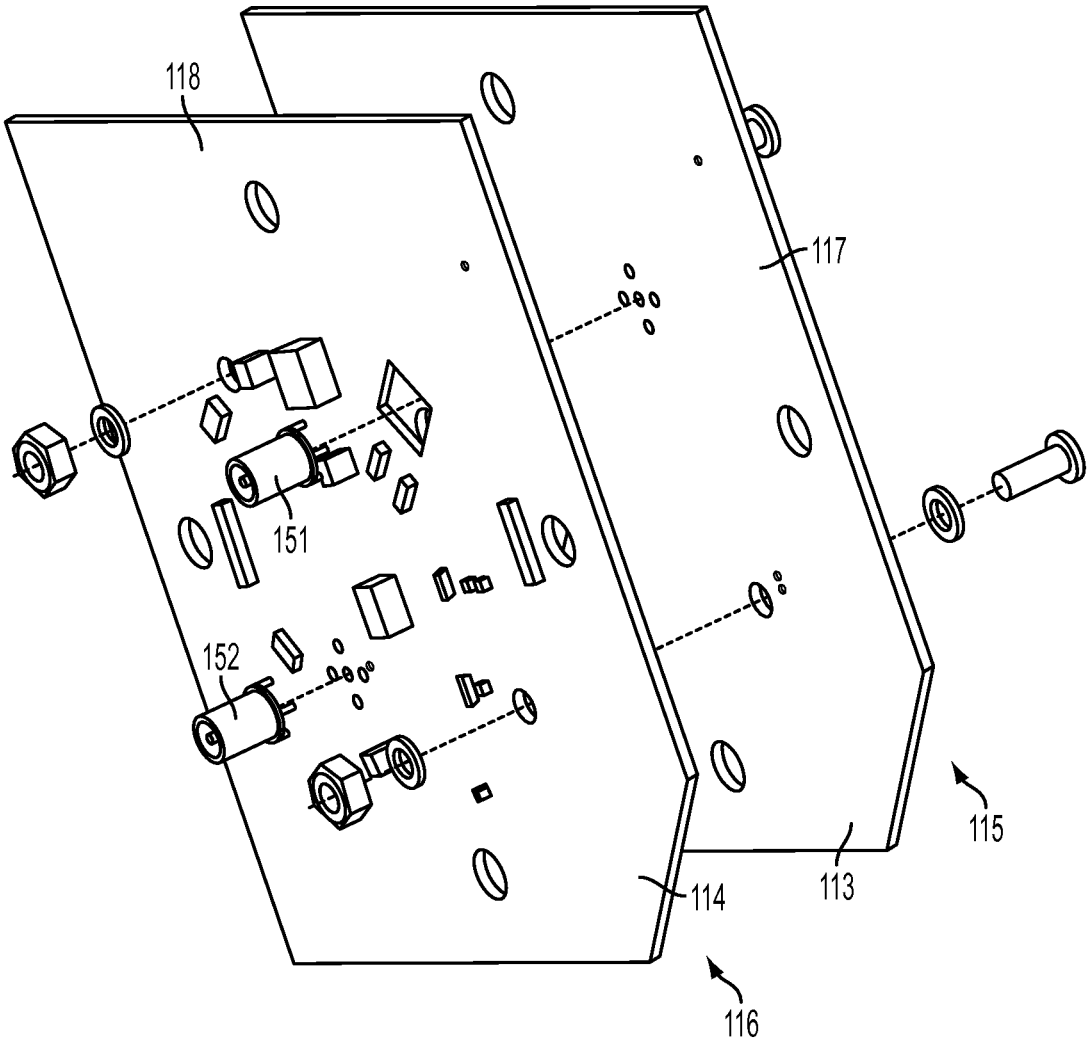
FIG. 11 shows assembly of the two printed circuit boards with their ground planes positioned to be moved into contact with each other and the component sides of the printed circuit boards facing outward.

FIG. 10 illustrates a pattern for a circuit board with instructions for populating the two back to back circuit boards that form the front end electronics. FIG. 11 shows assembly of the two printed circuit boards 117 and 118 with their ground planes 113 and 114 positioned to be moved into contact with each other and the component sides of the printed circuit boards facing outward. In this example, two sets of bolts and nuts extend through holes in the printed circuit boards to hold them in contact.

Each of the two circuit boards FEE A 117 and FEE B 118 has a solder mask and silkscreen only on the bottom layer (component side), as shown in FIG. 10 and FIG. 11. The top layer of the board is primarily a ground plane; gold plating on this layer is all that is needed (with no solder mask). The circuit board material can be standard FR4 with a thickness of 0.062". The circuit boards are "hard gold" plated.

The circuit boards 117, 118 are fixed together back-to-back with their ground planes in contact with each other. In an exemplary embodiment, a notch 115, 116 or cutout in the circuit boards allows the circuit boards to be easily aligned with the correct 90 degree rotation with respect to each other, and to be positioned with the correct orientation on the central mast hub, to ensure that all four of the dipole arms are electrically connected to their respective correct circuit. The plastic support hub for the front end electronics unit 102 can include a protrusion that fits into the notch so that the circuit board assembly can fit in the hub in only one orientation.

Each printed circuit board includes the front end electronics circuitry that processes the signals from one of the dipole antennas. Each circuit board includes two electrical connectors, or feed points for electrical connection to each of the dipole arms. In FIG. 11, the connectors are shown as elements 151 and 152. In this example, the FFE A S3 connector 151 mounts on the ground side of the FEE A circuit board 117 and passes through the FEE B circuit board 118. The FEE B circuit board 118 S3 connector 152 mounts on the component side of the FEE B circuit board 118.

The antenna's active balun's input impedance $Z_0$ is an important design parameter of the front end electronics, as it sets the bandwidth of the antenna system, the efficiency with which power is coupled into the antenna, and the mutual coupling with nearby antennas. Although high impedance baluns can be suitable for some designs because of their ability to buffer the widely varying dipole impedances over the relatively wide bandwidth of the antenna, it was found that raising the input impedance above 1 kilo ohm resulted in insufficient current flow into the balun, making it impossible to maintain sky noise dominated operation.

In an exemplary embodiment, the antenna topologies are optimized for desired beam pattern. A feedpoint impedance of approximately 100 Ohms is obtained by directly buffering the individual feedpoint connections with inexpensive commercially available MMIC amplifiers 802 and 803 that exhibit high input return loss. A 180 degree hybrid 801 or transformer converts the outputs of the amplifiers 802 and 803 to a single ended 50 Ohm output. This design avoids the loss, and subsequent increase in noise temperature, that are associated with adding transformers and other matching networks before the first amplification stage, and keeps production costs low. In this example, a voltage regulator 807 supplies 15 V DC to the front end electronics via a bias-T.

A 5th order, low-pass Butterworth filter 808 is included before the final 12 dB gain stage 810 to define the bandpass and reject out-of-band interference that could drive the FEE into non-linear operation. The characteristics of the filter can be widely varied within the topology of the filter through component selection. In this example, the 3 dB point of the filter is at 150 MHz; at 250 MHz it achieves −21 dB of attenuation. The filter's high cut-off frequency of 150 MHz minimizes distortion in the working bandpass of 20-80 MHz. Application-specific filters can be selected to optimize the system's performance for a specific application.

Figure 12B:
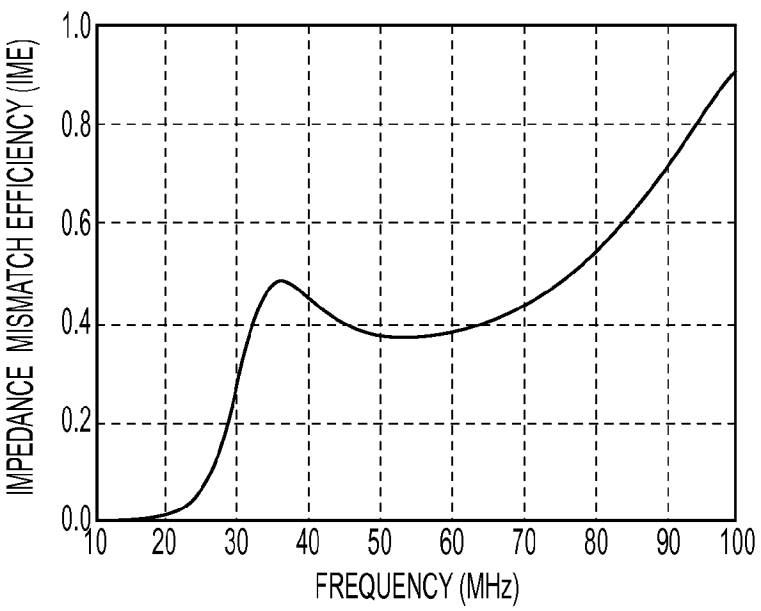
FIGS. 12A and 12B show the predicted impedance characteristics for the antenna system.
Figure 12A:
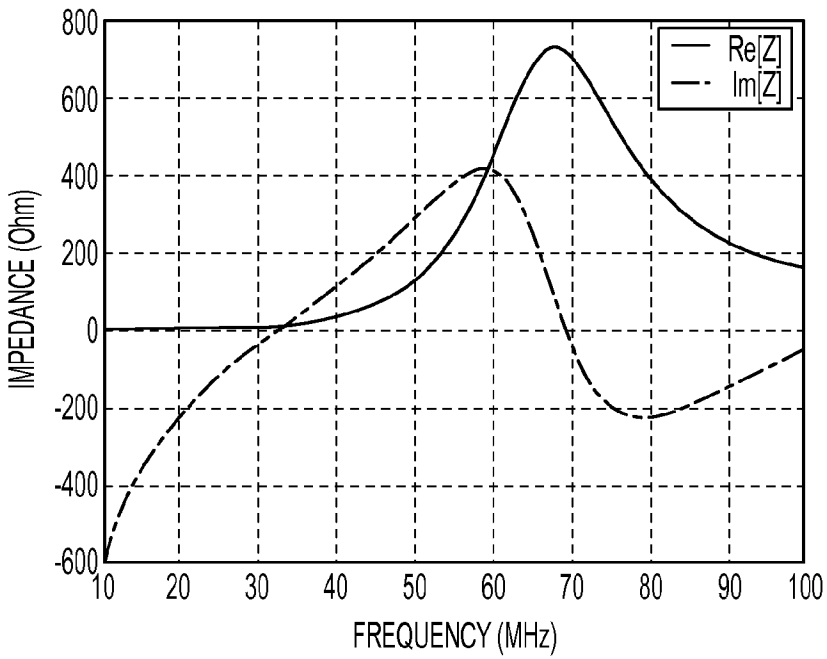

The predicted impedance characteristics for the antenna 100 are shown in FIGS. 12A and 12B. The antenna terminal impedance (Z) is shown in FIG. 12A and the impedance mismatch efficiency is shown in FIG. 12B. The impedance mismatch efficiency, or "IME", is the fraction of the power at the antenna feed point 805 or 806 that is transferred to the preamp.

The front end electronics unit 102 serves to fix the system noise temperature, match the antenna impedance to the coax signal cables running to the distantly located receiver, provide adequate gain to overcome cable loss, and limit out-of-band RFI presented to the analog receiver module. The performance a single polarization of the front end electronics was measured to be:

| Parameter | Value |
|---|---|
| Current draw at +15 VDC | 230 mA |
| Voltage range | ±5% |
| Gain | 35.5 dB |
| Noise Temperature | 255-273 K |
| Input 1 dB Compression point | −18.20 dBm |
| Input 3rd order intercept (IIP3) | −2.3 dBm |

The crossed polarization front end electronics unit will draw twice as much current as a single FEE board for a total of 460 mA at 15 V DC. The total power consumption for a 256 element, crossed dipole station is estimated to be approximately 1.8 kW.

Environmental testing of the final design of the front end electronics unit at temperature ranges between −0 and +40 degrees C. The gain dependence on temperature varies between 0.0042 dB/degree C. and 0.0054 dB/degree C., with the magnitude of the slope monotonically increasing with frequency between 20 MHz and 100 MHz. The phase also has a weak dependence on temperature, with a slope of 0.011 degrees/degree C. and 0.014 degrees/degree C.

In one example, one of the circuit boards includes a light emitting diode (not shown), to both show the user that the circuit is live and to allow a user to differentiate between the circuits by measuring the amperage drawn by the circuit with the LED.

Figure 13A:
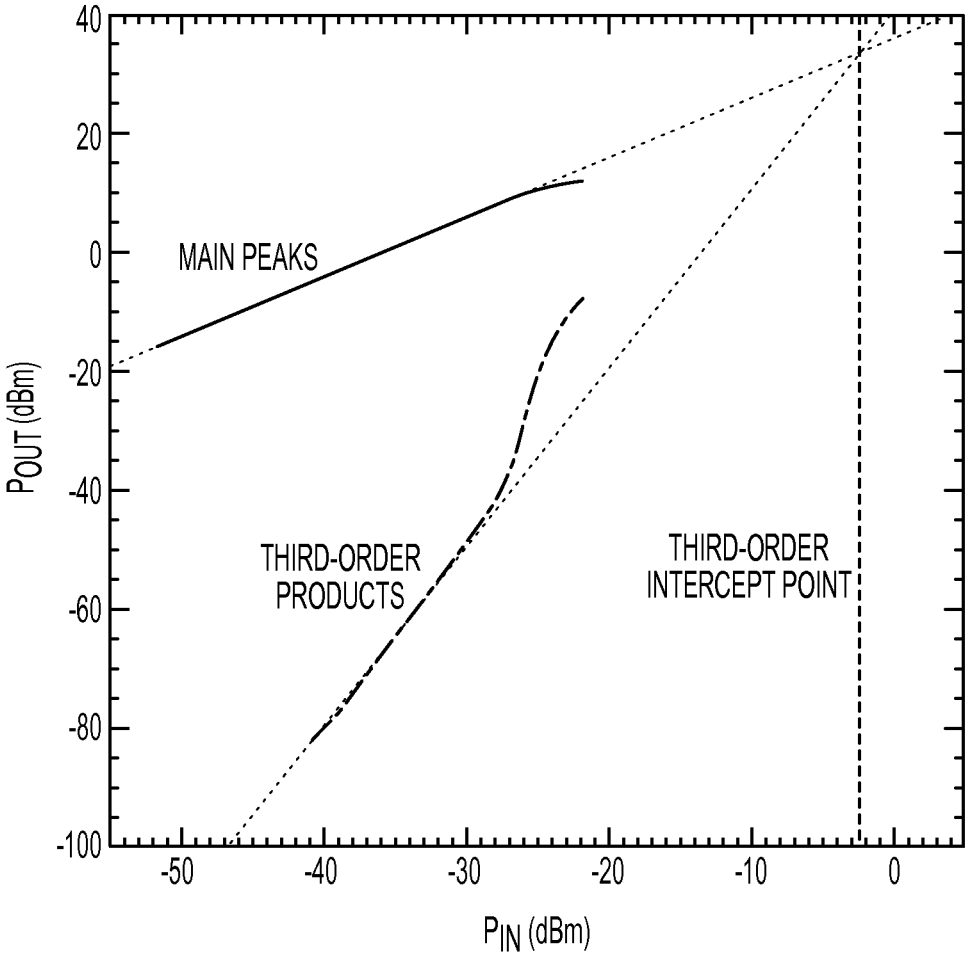
FIG. 13A illustrates the results of intermodulation distortion testing of the front end electronics unit.

FIG. 13A illustrates the results of intermodulation distortion testing of the front end electronics unit 102. The dotted trend lines have been fit to the vertical offset of the measured powers, but their slopes are fixed to 1 and 3. All powers have been corrected using the calibration results. The IIP3 is at −2.2 dBm.

Figure 13B:
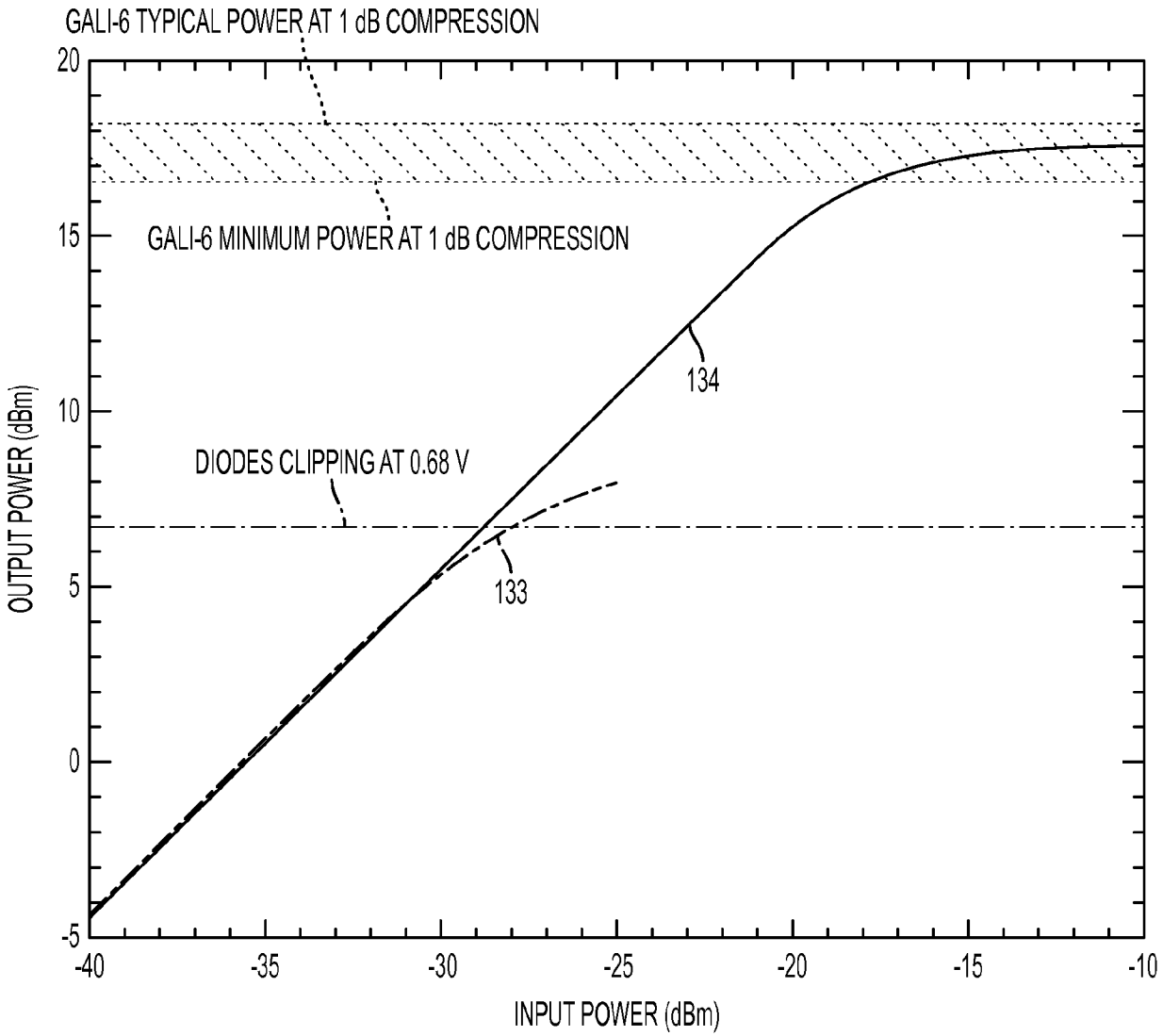
FIGS. 13B and 13C illustrate the front end electronics output power and the gain compression, respectively, as a function of input power for the front end electronics unit
Figure 13C:
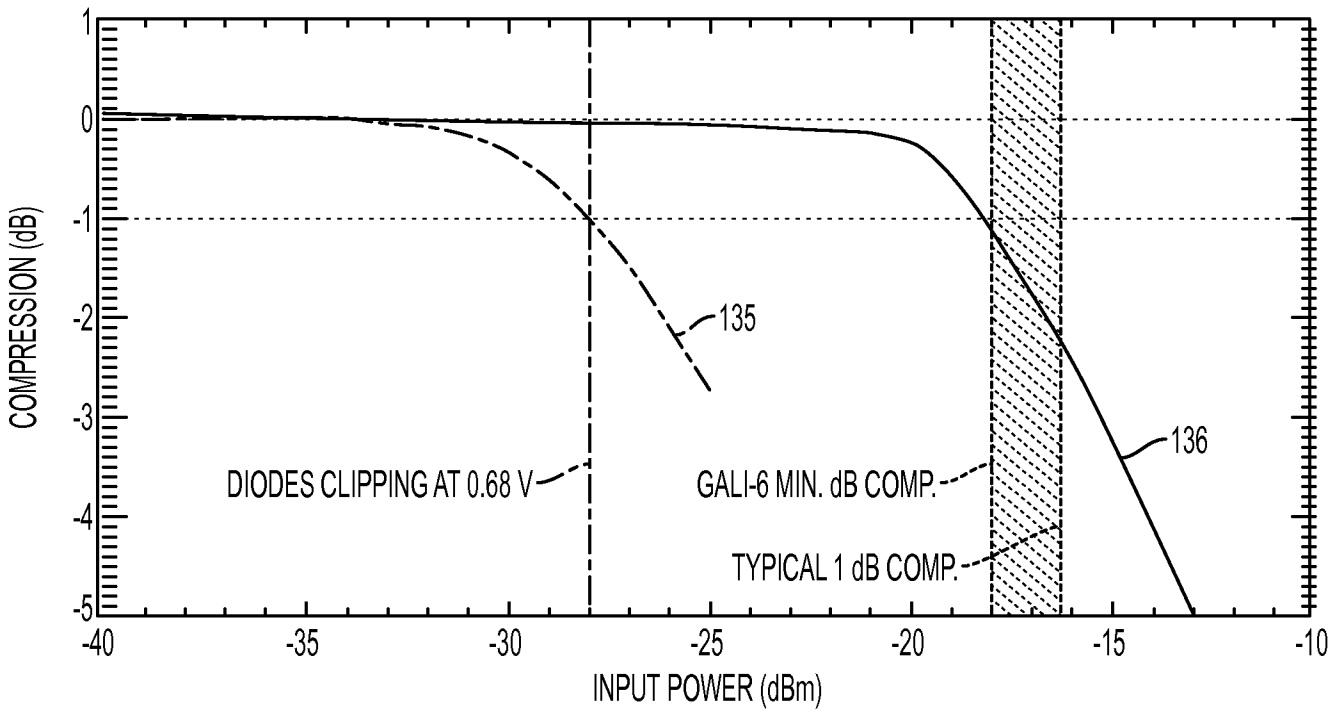

FIG. 13B illustrates the front end electronics output power as a function of input power for the front end electronics unit with protective diodes 133 and without protective diodes 134. and FIG. 13C illustrates the gain compression as a function of input power for the front end electronics unit with protective diodes 135 and without protective diodes 136.

A ground screen reduces ground losses and reduces susceptibility to variable soil conditions. Additionally, for an antenna in isolation, a small ground screen provides these benefits without the axial asymmetry and significant sensitivity to RFI coming from the horizon that are caused by using a full-station ground screen. Initial studies indicate that the behavior of a random array of antennas should be qualitatively similar to that of an antenna in isolation.

In this example, each antenna has a 10×10 ft ground screen under each stand. The ground screen should have a lattice spacing that is less than 12 inches. In this example, a 4×4 inch galvanized welded wire mesh material was chosen, that is structurally sound and inexpensive, made with wire diameter of 14 gauge (approx 2 mm), and commercially available in rolls that are 6×200 feet. Each antenna requires two 6×10 ft sections of mesh, overlapped by 2 to make a 10×10 ft ground screen, so one of these rolls could be used to produce 10 complete ground screens. Considering possible wastage when cutting the mesh, approximately 27 rolls can produce 256 ground screens.

For the physical connection of the two ground screen sections, split splicing sleeves (Nicopress R stock number FS-2-3 FS-3-4) were used to physically connect the two ground screen sections, 6 sleeves per ground screen (1,700 for a full 256 antenna station, assuming a 10% loss). Simulations have shown that the performance of such a two-part ground screen is negligibly different from a single, unitary ground screen. The ground screens are anchored to the ground to prevent the buckling of the sides of the mesh. In this example, plastic tent stakes, 8 per ground screen, which were used. Installing the ground screen is accomplished by unrolling the mesh on a at surface, cutting it into ten foot sections and flipping each section upside down to prevent it from rolling back, overlapping two of the ten foot sections of mesh by two ft and connecting them using six splicing sleeves, spaced by two feet, and moving the ground screens to the position of each stand. Each ground screen is staked to the ground, with the sides of the square screen aligned in the E/W by N/S direction, with the ground screen centered on the center mast position. Each corner of the ground screen is staked, and one stake is put in the midpoint of each side to improve the stability. The ground screen is not attached to the mast or dipole arms, so the ground screens are electrically isolated from the mast and dipole arms.

Figure 14C:
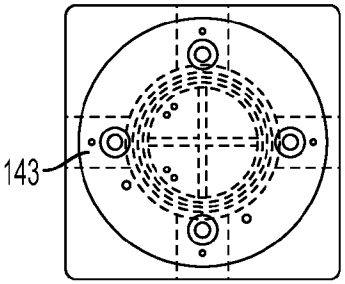
FIGS. 14A, 14B, and 14C illustrate the mechanical interface between the central mast and the other antenna elements.
Figure 14B:
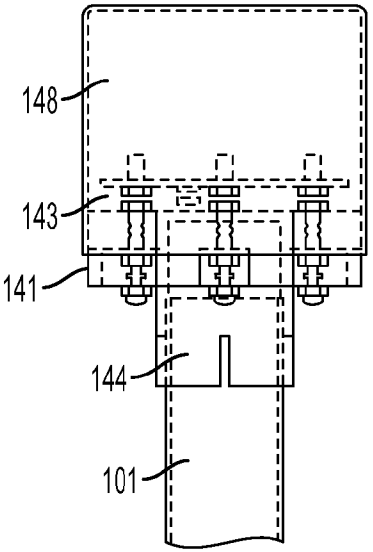
Figure 14A:
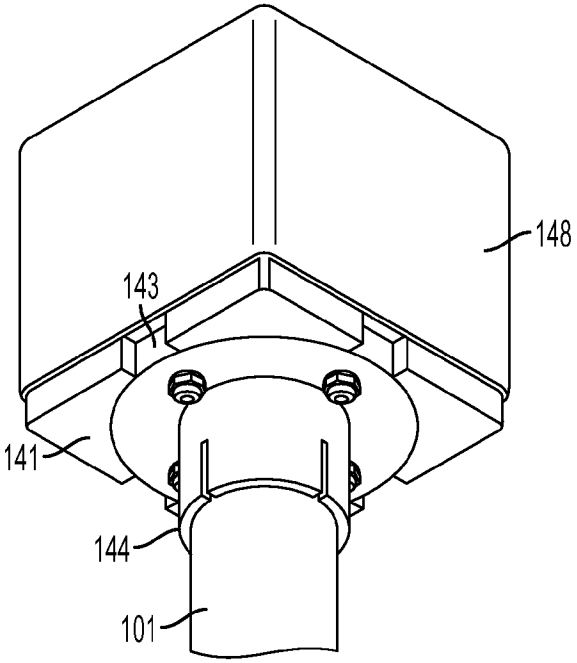

FIGS. 14A, 14B, and 14C illustrate the mechanical interface between the central mast and the other antenna elements. The hub base 141 is affixed to the mast 101. Each of the four dipole arms has an adapter at its apex that fits into one of four cavities 143 on the four sides of the hub base 141. After the dipole arms are positioned, the assembly is held in place with studs and hex jam nuts. The cover 148 protects the electronics from rain and other environmental effects.

For assembly, the hub base 141 is fitted with a compression collar 144 and set into the central mast. In order to ensure that the dipole arms are aligned in the north-south and east-west directions, respectively, the central mast and hub, to which the dipole arms are attached, must initially be properly aligned. Alignment of the units is accomplished using a inexpensive 4× sighting telescope mounted onto a base that is identical in shape, polarization keying, and mounting holes to an FEE unit. Through surveying, the angular offset at the STD installation point from True North to a distant, geographic reference point is established in advance and the telescope is firmly mounted to the base with that offset. The antenna hub is then rotated until the distant reference appears in the crosshairs of the sighting telescope, indicating that the hub is properly aligned and ready to be locked in place. Once aligned, the hub is locked into position and the base and sighting telescope unit is removed. This allows rapid and precise alignment by untrained personnel, and can produce repeatable alignment within 5 degrees.

The present system provides a galactic background limited by 6 dB across wide bandwidth (20-80 MHz), an upward looking beam pattern optimized in synthetic aperture arrays, with dual polarization with high isolation. The system is optimized for low cost manufacturing, with an estimated cost per antenna of about $100 each for more than 10,000 units. It can be quickly and easily assembled by inexperienced personnel, and the mean time between failure is estimated to be greater than 10 years.

In contrast, previously designed systems included passive antennas requiring long integrations to overcome intrinsic losses or traditional antenna designs that incorporated single-ended feedpoint amplifiers that followed the loss of a passive balun. These systems were unable to meet the system design goals set forth in the technical specifications for the Long Wavelength Array.

Obviously, many modifications and variations of the present invention are possible in light of the above teachings. It is therefore to be understood that the claimed invention may be practiced otherwise than as specifically described.

What is claimed as new and desired to be protected by Letters Patent of the United States is:

1. An active antenna system for receiving electromagnetic radiation comprising:

a vertical support mast;

a front end electronics unit including an active balun and two circuit boards, the front end electronics unit affixed to the support mast; and two crossed-dipole antennas oriented at about 90 degrees to each other, each crossed-dipole antenna having two arms formed of electrically conductive material, each arm having an isoceles triangular frame with an apex of the frame electrically connected to a feedpoint of the front end electronics unit, each arm also having a longitudinal member extending from the apex to the center of the base of the triangular frame and a cross member extending between sides of the triangular frame, each of the two circuit boards having feed points for electrical connection to one of the two crossed-dipole antennas.

2. The active antenna system according to claim 1, wherein each arm is oriented downward at about 45 degrees from a horizontal plane.

3. The active antenna system according to claim 1, further comprising:

a ground screen positioned below the cross dipole antennas.

4. The active antenna system according to claim 3, wherein the ground screen is an electrically conductive wire mesh with a lattice spacing less than twelve inches.

5. The active antenna system according to claim 1, wherein the circuit boards are affixed back-to-back with their ground planes connected to each other.

6. The active antenna system according to claim 5, wherein one of the circuit boards is oriented at about 90 degrees with respect to the other of the circuit boards.

7. An active antenna system for receiving electromagnetic radiation comprising:

a vertical support mast;

a front end electronics unit including an active balun, the front end electronics unit affixed to the support mast; and two crossed-dipole antennas oriented at about 90 degrees to each other, the front end electronics unit comprising two circuit boards, with each of the two circuit boards having feed points for electrical connection to one of the two crossed-dipole antennas, and wherein the circuit boards are affixed back-to-back with their ground planes connected to each other, and wherein one of the circuit boards is rotationally oriented at about 90 degrees with respect to the other of the circuit boards.

* * * * *